US005925580A

United States Patent [19]

Midorikawa

[11] Patent Number: 5,925,580

[45] Date of Patent: Jul. 20, 1999

[54] REPELLENT CLOTH USING FLUOROPLASTIC FIBERS

[75] Inventor: Yoshio Midorikawa, Tokyo, Japan

[73] Assignee: Toyo Polymer Co., Ltd., Tokyo, Japan

[21] Appl. No.: 08/831,427

[22] Filed: Apr. 1, 1997

Related U.S. Application Data

[63] Continuation-in-part of application No. 08/638,758, Apr. 29, 1996, abandoned.

[51] Int. Cl.[6] ..... D03D 15/00

[52] U.S. Cl. ..... 442/199; 139/383 R; 139/420 A; 442/181; 442/301

[58] Field of Search ..... 442/199, 301, 442/181; 139/420 R, 383 R

[56] References Cited

U.S. PATENT DOCUMENTS

| | | | |
|---|---|---|---|
| 3,561,441 | 2/1971 | Lombardi . | |
| 4,518,650 | 5/1985 | Grot et al. | 428/286 |
| 5,334,446 | 8/1994 | Quantrille et al. | 428/284 |
| 5,399,418 | 3/1995 | Hartmanns et al. . | |
| 5,413,849 | 5/1995 | Austin et al. | 428/293 |

*Primary Examiner*—James J. Bell
*Attorney, Agent, or Firm*—Stevens, Davis, Miller & Mosher, L.L.P.

[57] ABSTRACT

A repellent cloth in which repellency is added to the cloth by manufacturing cloth with expensive fluoroplastic fibers in amounts sufficient to impart 80% repellency to the cloth.

6 Claims, 4 Drawing Sheets

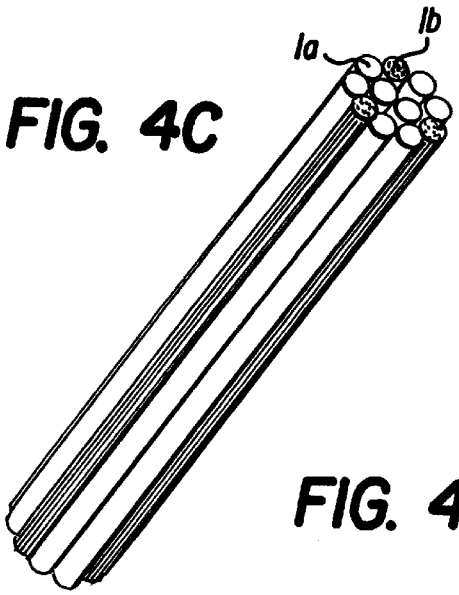
FIG. 4C
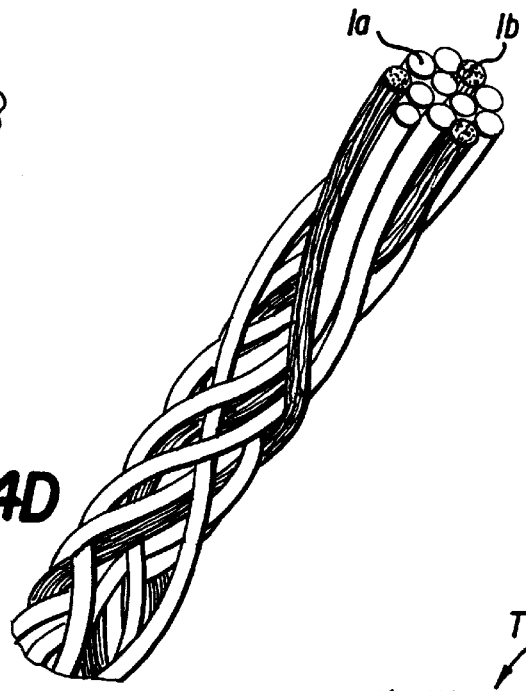
FIG. 4D
FIG. 4E
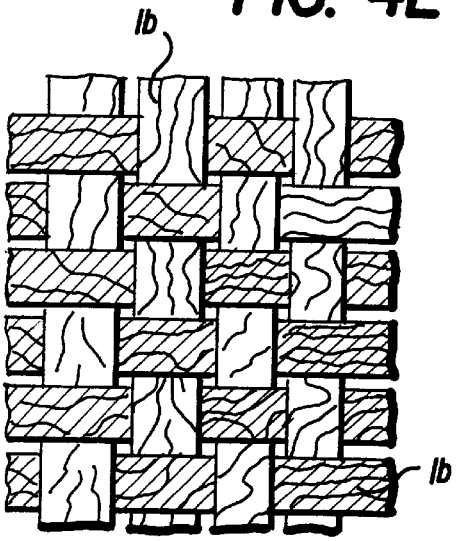
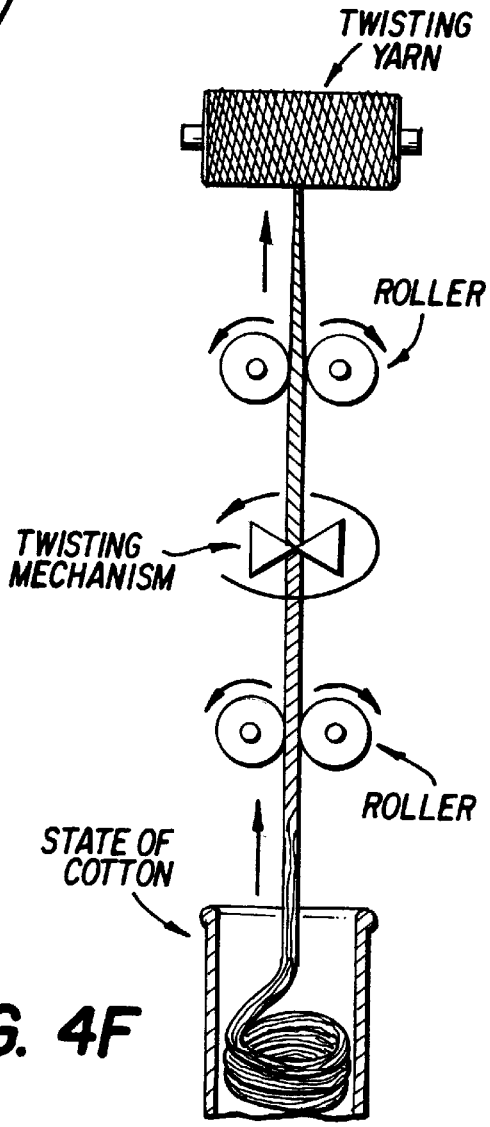
FIG. 4F

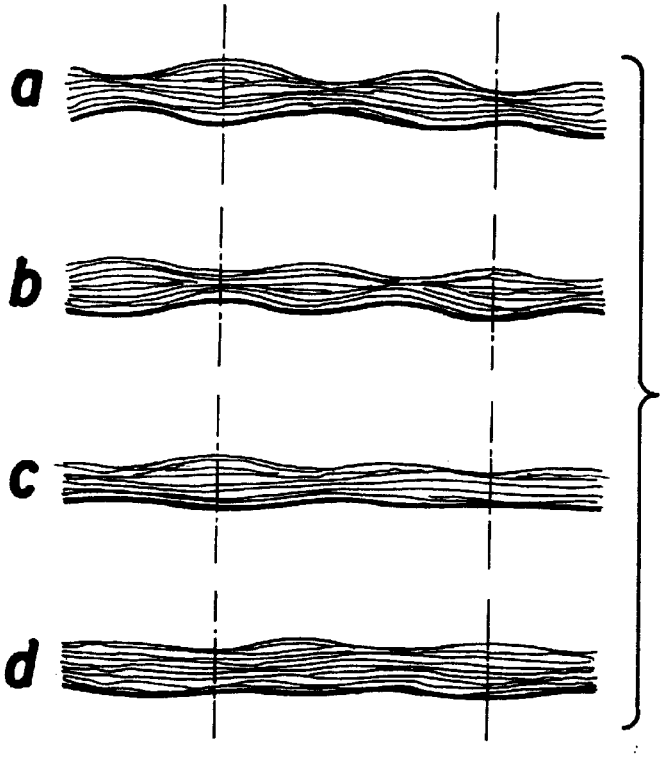
FIG. 4G
FIG. 5A
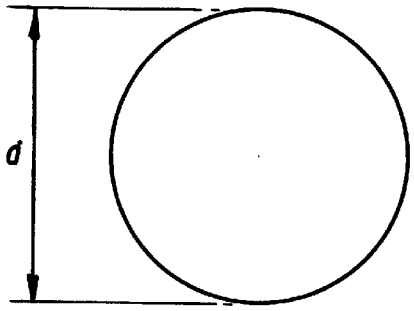
SURFACE AREA FOR REPELLENT EFFECT $\pi d$
FIG. 5B
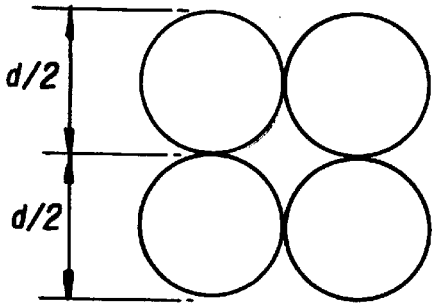
SURFACE AREA FOR REPELLENT EFFECT $\frac{\pi}{2} d \times 4 = 2\pi d$
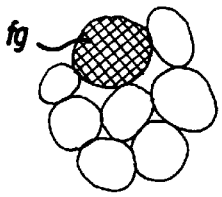
FIG. 6A
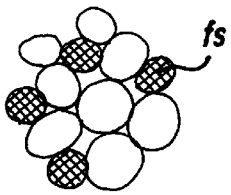
FIG. 6B

REPELLENT CLOTH USING FLUOROPLASTIC FIBERS

RELATED APPLICATIONS

This application is a continuation-in-part application of U.S. application Ser. No. 08/638,758, herein incorporated by reference, filed Apr. 29, 1996, which is abandoned upon the grant of a filing date of this application.

BACKGROUND OF THE INVENTION

1. Field of the Invention

The present invention relates to cloth obtained by blending base fibers such as synthetic fibers, for example rayon, nylon, etc., and natural fibers, for example, wool, cotton, silk, hemp,, etc. with fluoroplastic fibers. The produced blended cloth is endowed with excellent properties of the fluoroplastic fibers while retaining the beneficial properties of the base fibers. The invention also relates to a method for producing the same.

The excellent properties of fluoroplastic fibers include repellency, non-tackiness, wear resistance, chemicals resistance, heat resistance, etc. These properties can be imparted to a cloth which includes the base fibers by incorporating fluoroplastic fibers into the cloth. The produced cloth thus retains all the beneficial properties of the base cloth with the added benefits of the properties imparted to the cloth by the fluoroplastic fibers.

Such cloth can be used in a wide variety of fields and examples of which are as follows:

Clothes: Suits, sweaters and the like which repel water and which must be stain repellant; clothes that can be worn on a rainy day such as raincoats, jackets and the like which are rich in fashion and have a rain resistant performance. Children's clothes and the like which require stain resistance and wear resistance.

Sports: Clothes such as jackets, slacks and the like for outdoor sports, including swimming suits having water repellency and low frictional properties.

Interior finish work: Carpets, curtains, sheets and the like (for theaters, vehicles and homes) which are stain resistant and easy to clean.

Medical use: Sheets, scrubs and other operational clothes, bandages, adhesive tapes and the like.

Other cloth: Fire hoses, filter cloth, ropes and the like.

Miscellaneous: shoes, umbrellas and the like.

2. Description of Prior Art

Conventional repellent cloth generally includes cloth to which repellency is imparted by coating or spraying a repellent component of silicon or fluoride on the surface of cloth. Repellency is also added to cloth by making the cloth with yarns in which a repellent component is coated thereon.

Such cloth provides an initial repellency, but the repellency is reduced materially as a result of wear and washing. The repellency effect after several washes is lost completely. The repellency can also be lost in a single area of the cloth, even prior to being washed out, when a portion of the cloth is subjected to continuous rubbing.

In addition to the problems discussed above, foreign matter is coated onto the surfaces of fiber and cloth. This coating impairs both the feel and drape of cloth which may impair the value of the cloth.

It is an object of the present invention to: provide a cloth which has overcome the aforementioned drawbacks. That is, the present invention provides a cloth in which repellency is not lost by rubbing or washing; a cloth which maintains its repellency semi-permanently and whose feel and drape is not impaired.

SUMMARY OF THE INVENTION

According to the present invention, there is provided a repellent cloth in which repellency of the cloth is obtained by incorporating therein expensive fluoroplastic fibers in amounts sufficient to impart 80% repellency thereto.

The present invention includes the following:

A method for producing a repellent cloth having fluoroplastic fibers blended therein, the method comprising: selecting wool, cotton and silk as base fibers, blending 5–10% by weight of fluoroplastic fibers of 5 to 20 denier per 100% by weight of at least one of said base fibers to form a fiber blend, forming a twist yarn from said blend, and using the thus obtained twist yarn to weave a cloth retaining about 80% of its repellant properties after multiple washes.

BRIEF DESCRIPTION OF THE DRAWINGS

FIGS. 4*c–e* show a fiber bundle containing base fibers and fluoroplastic fibers prior to twisting, after twisting and after its incorporation into a weave;

FIG. 4*f* shows how the yarn is twisted;

FIG. 4*g* shows a sliver becoming gradually more uniform as it passes through a Drawing Frame;

FIGS. 5*a* and 5*b* are comparisons illustrating the repellant effect as exhibited by fluoroplastic fibers of different coarseness;

FIGS. 6*a* and 6*b* show cross sections of two different twist fibers with fluoroplastic fibers of different coarseness.

DETAILED DESCRIPTION OF THE INVENTION

The inventor has discovered a minimum rate for blending fluoroplastic fibers with base fibers so that a cloth product produced from a fiber blend of base fibers and fluoroplastic fibers retains a repellency rate of 80%. The discovery allows a manufacturer to reduce costs in producing cloth without impairing the feel and handle while imparting to the cloth an ability to retain 80% repellency even after the cloth is subjected to multiple washing cycles.

Figure 4A:
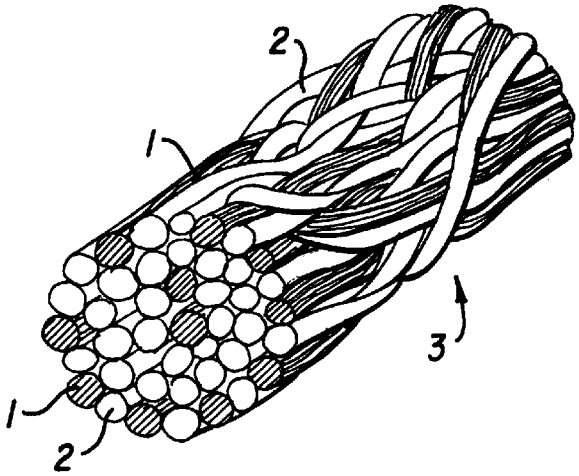
FIGS. 4*a* and 4*b* show blended twist yarns having fluoroplastic fibers of 10 denier and 30 denier, respectively.
Figure 4B:
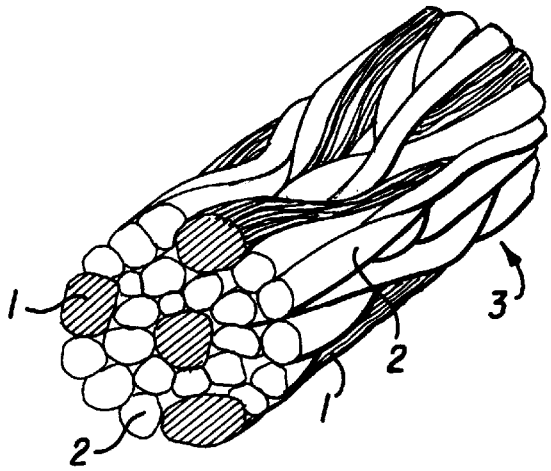

The base fibers are synthetic fibers, for example rayon, nylon, etc., and natural fibers, for example, wool, cotton, silk, hemp,, etc.. Base fiber and fluoroplastic fibers are blended at a rate of 5–10% by weight of fluoroplastic fibers of 5 to 20 denier per 100% by weight of at least one base fiber. Blending is achieved by methods known to artisans of ordinary skill in the art. More particularly, base fibers are merely combined with the fluoroplastic fibers creating base fiber/fluoroplastic fiber mixtures. These mixtures are blended by hand and then the mixtures are subjected to carding to align the fibers as shown in FIG. 4*c*. After carding two slivers of blended fibers are directed to a drawing frame which purpose is to make the fibers uniform and parallel. The drawing frame settles the fibers forming a single raw sliver of uniform diameter as shown in FIG. 4*g*. As shown from *a–d* the diameter of the sliver gradually becomes more uniform. The raw yarn is extended and then the fibers are twisted in a known manner creating yarn (see FIG. 4*d*) with equipment that is standard or conventional in the art such as a "MULE", "FLYER", "RING" or "CAP". The diameter of the yarn and the twist given the yarn are conventional and are not unlike the yarn used to produce a typical mens business suit.

Thereafter the twisted yarns are woven as shown in FIG. 4*e* to produce a woven fabric.

FIGS. 5(*a*) and (*b*) illustrate the result of blending fluoroplastic fibers of equal weight, but of different coarseness with base fibers; fibers of reduced coarseness have a greater surface area, and thus enhance the repellent effect relative to blends using fewer fibers of greater coarseness.

The table below further illustrates this point:

| | Coarse fiber | | Less coarse fiber |
|---|---|---|---|
| Total weight: | A | | A |
| No. of fluoroplastic fibers | m | < | n |
| Coarseness of fluoroplastic fibers | $\alpha$ | > | $\beta$ |
| Surface area for repellent effect | B ($\pi\alpha \times m$) | | C ($\pi\beta \times n$) |

From the above, when $m<n$ and $\alpha>\beta$ then $B(\pi\alpha X\ m)<C(\pi\beta X\ n)$. See FIGS. 5(*a*)and 5*b*. In other words, if the total weight of the less coarse fibers is equal in weight to fibers having a greater coarseness, the less coarse fibers will achieve a greater repellency than the fibers having a greater coarseness. It follows that one can use a reduced weight amount of less course fibers to achieve a repellency rate achieved by the fibers having a greater coarseness. The economics are thus improved.

The invention is further illustrated with reference to the following non-limiting examples:

EXAMPLE 1

Tetrafluoroethylene-hexafluoropropylene (FEP) resin fibers of 1 denier, 5 denier, 10 denier, 20 denier and 30 denier were blended with 100 wt. % of wool fibers to obtain a twist yarn. The twist yarns were woven to obtain a woven cloth. Repellent degree tests were conducted before and after multiple washing cycles of the cloth.

The repellent degree tests were conducted in accordance with JIS L1092 "5.2 Repellent degree test (spray test)". According to this test, it is determined that if the repellency exceeds 80%, the repellent effect is satisfactory for practical use.

After taking an initial repellant measurement the woven cloth was washed by a home electric washing machine using 1.7 g/l of detergent "ZABU" at 40° C. for 5 minutes×3 times. The washed cloth was dried and ironed.

After the above-described washing operation was repeated 10 times, the repellent degree test JIS L1092 5.2 was repeated.

As the result of the repellent degree test, the minimum blending rate of the FEP fibers to obtain an 80% repellant degree was found to be as follows:

| | |
|---|---|
| 1 denier | 2 wt. % |
| 5 denier | 5 wt. % |
| 10 denier | 8 wt. % |
| 20 denier | 10 wt. % |
| 30 denier | 43 wt. % |

Figure 1:
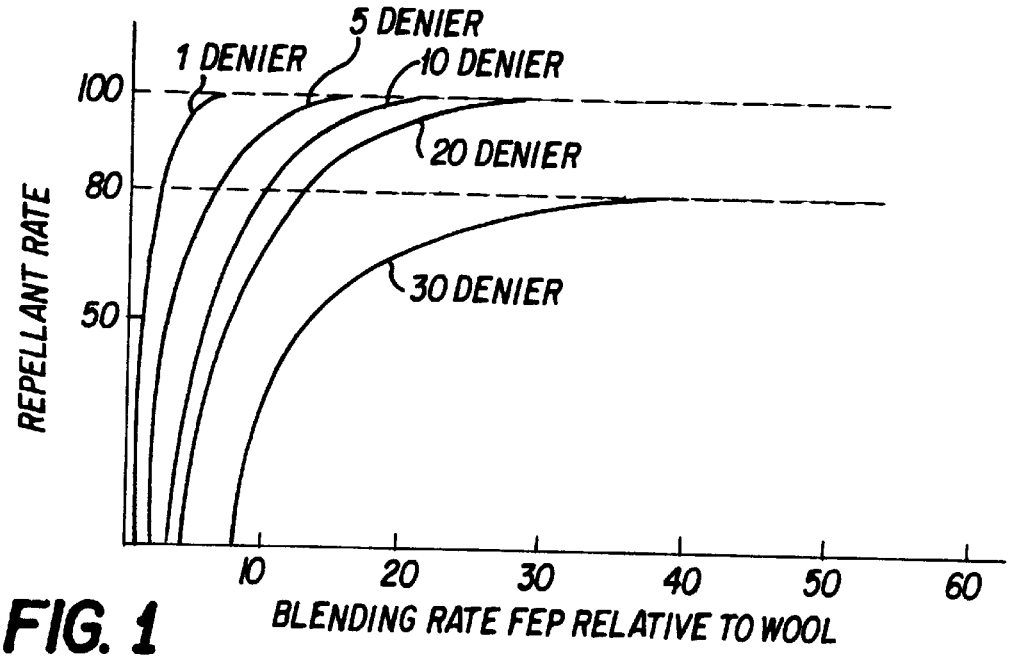
FIG. 1 is a graph showing the results of a repellency test by coarseness of FEP fluoroplastic fibers.

FIG. 1 for plotted results.

Further, in place of wool used in Example 1, cotton and silk were used as base fibers and FEP fibers of 5 to 20 denier were blended therewith to obtain a twist yarn. The twist yarn was woven to obtain woven cloth for which the repellent degree test was conducted before and after washing. As the result, the minimum blending rate of the FEP fibers similar to Example 1 was obtained despite the exchange of the base fibers.

EXAMPLE 2

Figure 2:
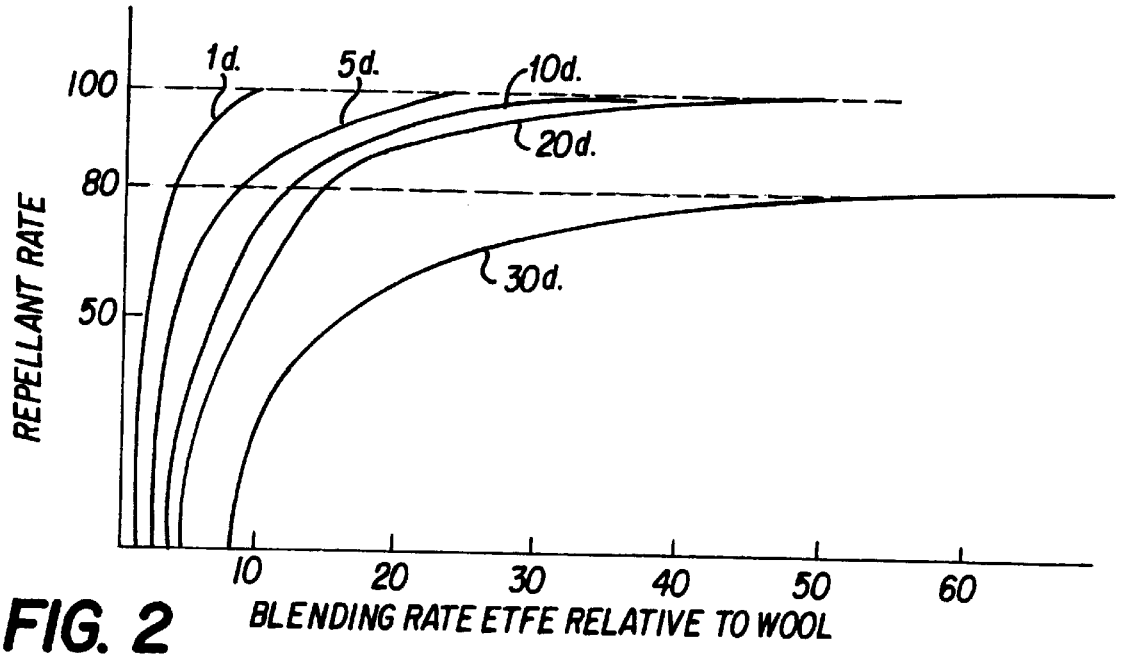
FIG. 2 is a graph showing the results of a repellency test by coarseness of ETFE fluoroplastic fibers.

Ethylene tetrafluoroethylene (ETFE) copolymer resin fibers of 1 denier, 5 denier, 10 denier, 20 denier and 30 denier fibers as were blended with 100 wt. % of wool fibers to obtain a twist yarn. The twist yarn was woven to obtain a woven cloth. As in Example 1 the test of repellent degree was conducted before and after washing. The results are plotted in FIG. 2.

As the result of the repellent degree test, the minimum blending rate for obtaining a repellent degree of 80% is as follows for ETFE fibers:

| | |
|---|---|
| 1 denier | 3 wt. % |
| 5 denier | 7 wt. % |
| 10 denier | 8 wt. % |
| 20 denier | 11 wt. % |
| 30 denier | 60 wt. % |

From the above-described result, it is found that in Example 2, by using the ETFE fibers which are 5 to 20 denier, a high repellent degree can be obtained.

Similar to Example 1, the repellent degree of the cloth remained substantially constant as determined from data acquired before washing and after washing.

EXAMPLE 3

Figure 3:
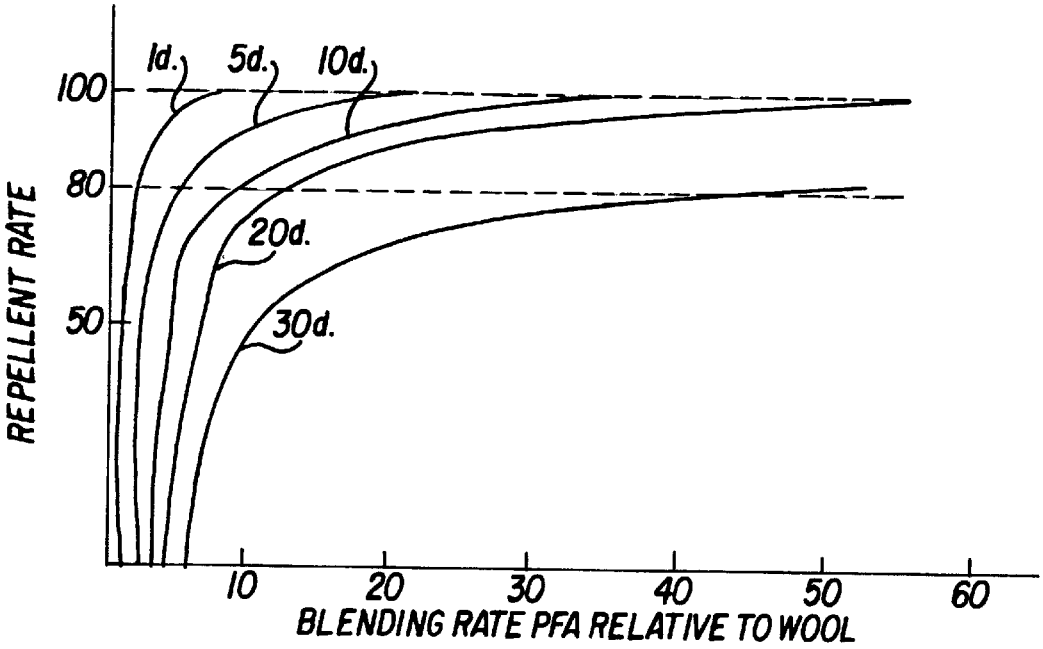
FIG. 3 is a graph showing the results of a repellency test by coarseness of PFA fluoroplastic fibers.

Tetrafluoroethylene-per-fluoroalkyl vinyl ether (PFA) copolymer resin fibers of 1 denier, 5 denier, 10 denier, 20 denier and 30 denier fibers, were blended with 100 wt. % of wool fibers to obtain a twist yarn. The twist yarn was woven to obtain a woven cloth. The test of repellent degree before and after washing was conducted. The results are shown in FIG. 3.

As the result of the repellent degree test, the minimum blending rate for obtaining a repellent degree of 80% is as follows for PFA fibers:

| | |
|---|---|
| 1 denier | 2 wt. % |
| 5 denier | 4 wt. % |
| 10 denier | 7 wt. % |
| 20 denier | 10 wt. % |
| 30 denier | 45 wt. % |

From the above-described result, it is found that in Example 3, by using the PFA fibers which are 5 to 20 denier, the high repellent degree can be maintained by blending a base fiber with PFA fibers.

Similar to Example 1, the repellent degree of the cloth remained substantially constant as determined from data acquired before washing and after washing.

What is claimed is:

1. A cloth retaining about 80% of its initial repellent properties after multiple washes, which comprises a blend of 5–10% by weight of a fluoroplastic fiber selected from the group consisting of tetrafluoroethylene-hexafluoropropylene, ethylene tetrafluoroethylene, and tetrafluoroethylene-per-fluoroalkyl vinyl ether, and 5–10 denier per 100% by weight of a base fiber selected from the group consisting of wool, cotton and silk forming a twisted yarn woven into said cloth.

2. The cloth of claim 1 further comprising 20 denier fluoroplastic fibers, wherein each said fluoroplastic fiber is tetrafluoroethylene-hexafluoropropylene and its minimum blending weight percent with 100% by weight of base fiber that ensures cloth having a repellent degree of 80% is:

| | |
|---|---|
| 5 denier | 5 wt. % |
| 10 denier | 8 wt. % |
| 20 denier | 10 wt. %. |

3. The cloth of claim 1 further comprising 20 denier fluoroplastic fibers, wherein each said fluoroplastic fiber is ethylene tetrafluoroethylene and its minimum blending weight percent with 100% by weight of base fiber that ensures cloth having a repellent degree of 80% is:

| | |
|---|---|
| 5 denier | 7 wt. % |
| 10 denier | 8 wt. % |
| 20 denier | 11 wt. %. |

4. The cloth of claim 1 further comprising 20 denier fluoroplastic fibers, wherein each said fluoroplastic fiber is tetrafluoroethylene-per-fluoroalkyl vinyl ether and its minimum blending weight percent with 100% by weight of base fiber that ensures cloth having a repellent degree of 80% is:

| | |
|---|---|
| 5 denier | 4 wt. % |
| 10 denier | 7 wt. % |
| 20 denier | 10 wt. %. |

5. The cloth of claim 1 wherein the base fiber is cotton.

6. The cloth of claim 1 wherein the base fiber is cotton.

* * * * *